US009640338B2

(12) United States Patent
Abe et al.

(10) Patent No.: US 9,640,338 B2
(45) Date of Patent: May 2, 2017

(54) PRESS OPERATION APPARATUS

(71) Applicant: ALPS ELECTRIC CO., LTD., Tokyo (JP)

(72) Inventors: Yoshibumi Abe, Miyagi-ken (JP); Zenko Motoki, Miyagi-ken (JP); Minoru Sato, Miyagi-ken (JP); Akira Kabamoto, Miyagi-ken (JP); Jun Taniguchi, Miyagi-ken (JP); Kohei Ishizawa, Miyagi-ken (JP); Shinichi Nishimura, Miyagi-ken (JP); Yukiteru Yano, Tokyo (JP)

(73) Assignee: ALPS ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 15/169,266

(22) Filed: May 31, 2016

(65) Prior Publication Data

US 2016/0351348 A1 Dec. 1, 2016

(30) Foreign Application Priority Data

Jun. 1, 2015 (JP) ..... 2015-111484

(51) Int. Cl.
*H01H 3/12* (2006.01)

(52) U.S. Cl.
CPC ..... *H01H 3/122* (2013.01); *H01H 2221/03* (2013.01); *H01H 2221/058* (2013.01); *H01H 2235/018* (2013.01); *H01H 2235/028* (2013.01)

(58) Field of Classification Search
CPC ..... H01H 13/14; H01H 13/705; H01H 3/122; H01H 2221/03; H01H 2221/058; H01H 2235/018; H01H 2235/028
USPC ..... 200/344, 5 A, 512–517, 314, 341–343, 200/345, 520
See application file for complete search history.

(56) References Cited

U.S. PATENT DOCUMENTS 6,297,461 B1 * 10/2001 Kamishima ..... G06F 1/1616 200/344
7,122,756 B2 * 10/2006 Sasaki ..... H01H 13/28 200/16 C
8,299,382 B2 * 10/2012 Takemae ..... H01H 3/125 200/341

FOREIGN PATENT DOCUMENTS

JP 2005-085655 3/2005

* cited by examiner

*Primary Examiner* — Edwin A. Leon
(74) *Attorney, Agent, or Firm* — Brinks Gilson & Lione

(57) ABSTRACT

When an operation body is urged upward by a flat spring and is in a return position, a projection disposed on the operation body is held between opposing positioning portions and the position of the operation body in an X-direction is set. When the operation body is pressed at a position away from a central portion of the operation body in the X-direction, the operation body pivots on one of retaining structures downward. At this time, the projection moves away from the opposing positioning portions, and resistance against a pressing operation can thereby be reduced.

4 Claims, 7 Drawing Sheets

PRESS OPERATION APPARATUS

CLAIM OF PRIORITY

This application claims benefit of priority to Japanese Patent Application No. 2015-111484 filed on Jun. 1, 2015, which is hereby incorporated by reference.

BACKGROUND

1. Field of the Disclosure

The present disclosure relates to a press operation apparatus installed in an operation panel for use in various electronics for vehicles or household electric appliances.

2. Description of the Related Art

In a press operation apparatus disclosed in Japanese Unexamined Patent Application Publication No. 2005-85655, press buttons, which are formed by combining quadrilateral front knobs and square tubular retainers, are fitted into a quadrilateral opening formed in a housing. The front knobs are arranged in lines within the opening. The retainers are slidably supported by the housing. The press buttons are urged in the front side direction by springs. A substrate is installed on the back side of the housing. The substrate is provided with switches that are pressed by the respective retainers.

On the side surfaces of each square tubular retainer that face four directions, four ribs are formed so as to extend in the direction in which the retainer moves. The ribs are slidably fitted into respective guide grooves formed in the housing. An end portion of each rib and an end portion of each guide groove are tapered. When the press buttons are returned to the front side by the urging force of the springs, the tapered portions of the ribs engage with the tapered portions of the guide grooves, and the positions of the press buttons are thereby set. In this way, clearances between the quadrilateral front knobs adjacent to one another can be made uniform.

In the press operation apparatus disclosed in Japanese Unexamined Patent Application Publication No. 2005-85655, the ribs, which are formed on the side surfaces of each square tubular retainer that face the four directions, slide into the guide grooves of the housing with little clearance. When one of the press buttons slides in the housing, all of the four-directional side surfaces of the corresponding retainer are restricted by the guide grooves.

Accordingly, when one of the front knobs is pressed at a position away from the center of the front knob, the retainer attempts to lean within the housing, and this increases resistance produced when the press button is depressed with the four-directional side surfaces restricted. The front knobs disclosed in Japanese Unexamined Patent Application Publication No. 2005-85655 include rectangular front knobs. There is an extremely high probability that such a rectangular front knob is pressed at a position away from the center, and the resistance produced when the front knob is pressed to depress the retainer tends to increase. There is also a need to accurately apply the urging force of each spring at the central position of the retainer. Furthermore, there is a tendency that the press buttons cannot surely be returned to the same position as before the press buttons are pressed unless the urging force is increased.

An increase in the clearance between the sliding portions of the rib and of the guide groove may reduce a sliding load when the front knob is depressed. The increase in the clearance, however, excessively increases the unsteadiness of the press button when the press button is pressed, which results in poor operability.

SUMMARY

A press operation apparatus includes a case, an operation body disposed on the case, a switch disposed in the case and configured to be activated by pressing the operation body, an urging member disposed on the case and urging the operation body in a direction opposite to a direction in which the operation body is pressed, retaining structures arranged so as to be spaced apart from each other in a first direction, and positioning structures arranged between the retaining structures so as to be spaced apart from each other in a second direction perpendicular to the first direction. Each of the positioning structures includes a projection and opposing positioning portions, the projection is disposed on one of the operation body and the case, the opposing positioning portions oppose each other in the first direction and are disposed on the other of the operation body and the case, the projection is interposed between the opposing positioning portions when the operation body is moving in the direction opposite to the direction in which the operation body is pressed, and a position of the operation body in the first direction is set. The projection moves away from the opposing positioning portions when the operation body is pressed and pivots on one of the retaining structures.

DESCRIPTION OF THE EXEMPLARY EMBODIMENTS

Figure 1:
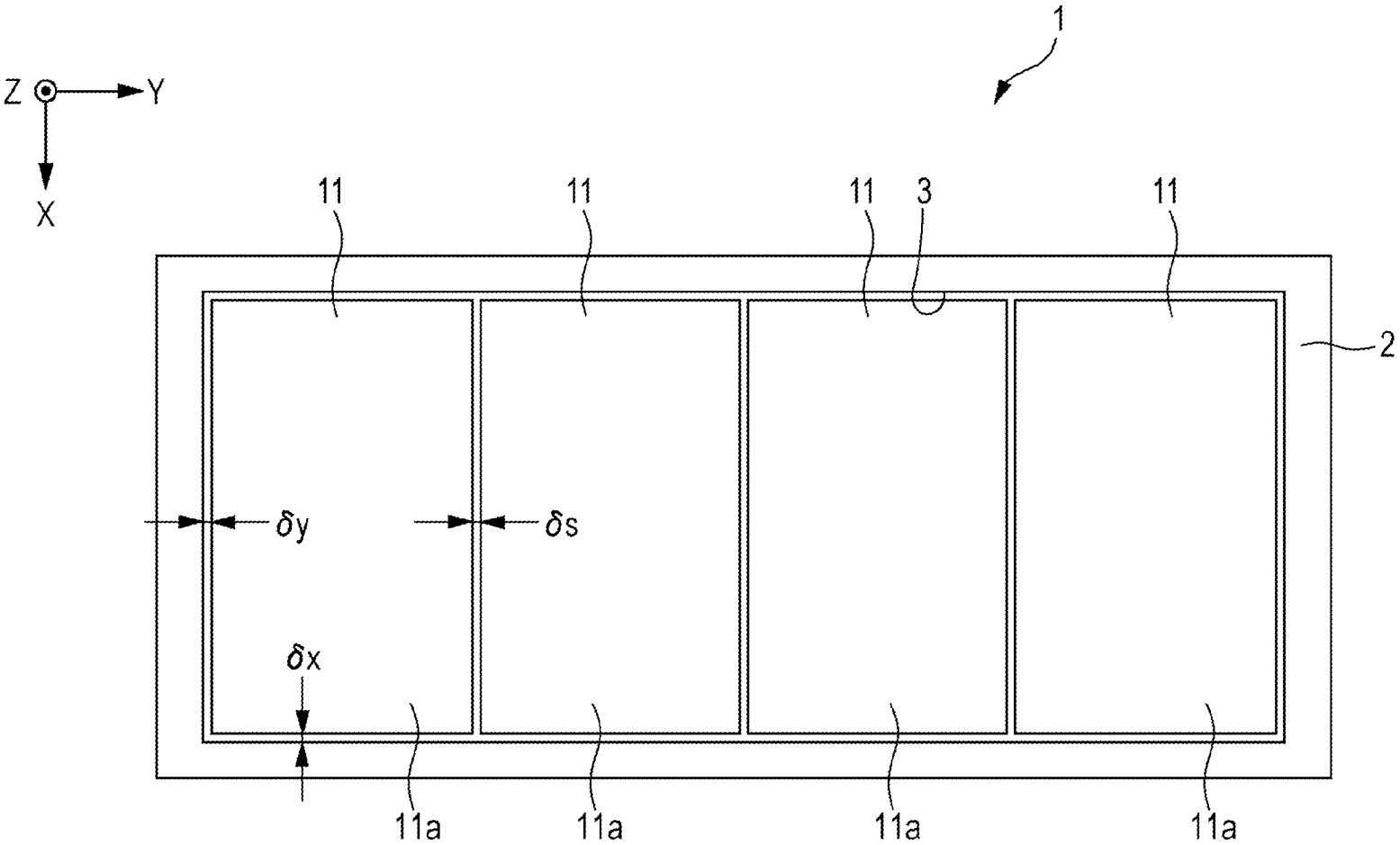
FIG. 1 is a plan view of an operation panel provided with press operation apparatuses according to an embodiment of the present invention.

FIG. 1 is a plan view of the structure of an operation panel 1 provided with press operation apparatuses 10 according to an embodiment of the present invention. The operation panel 1 is installed in operation sections such as various operation sections equipped in the interior of vehicles, operation sections of electronics for vehicles, operation sections of household electronics, or operation sections of industrial equipment.

In the embodiment, an X-direction is a first direction, a Y-direction perpendicular to the X-direction is a second direction, and a Z-direction perpendicular to the X-direction and the Y-direction is a third direction.

The operation panel 1 shown in FIG. 1 includes a panel surface 2. A rectangular opening 3 is formed in the panel surface 2. Four press operation apparatuses 10 are accommodated within the opening 3.

Figure 2:
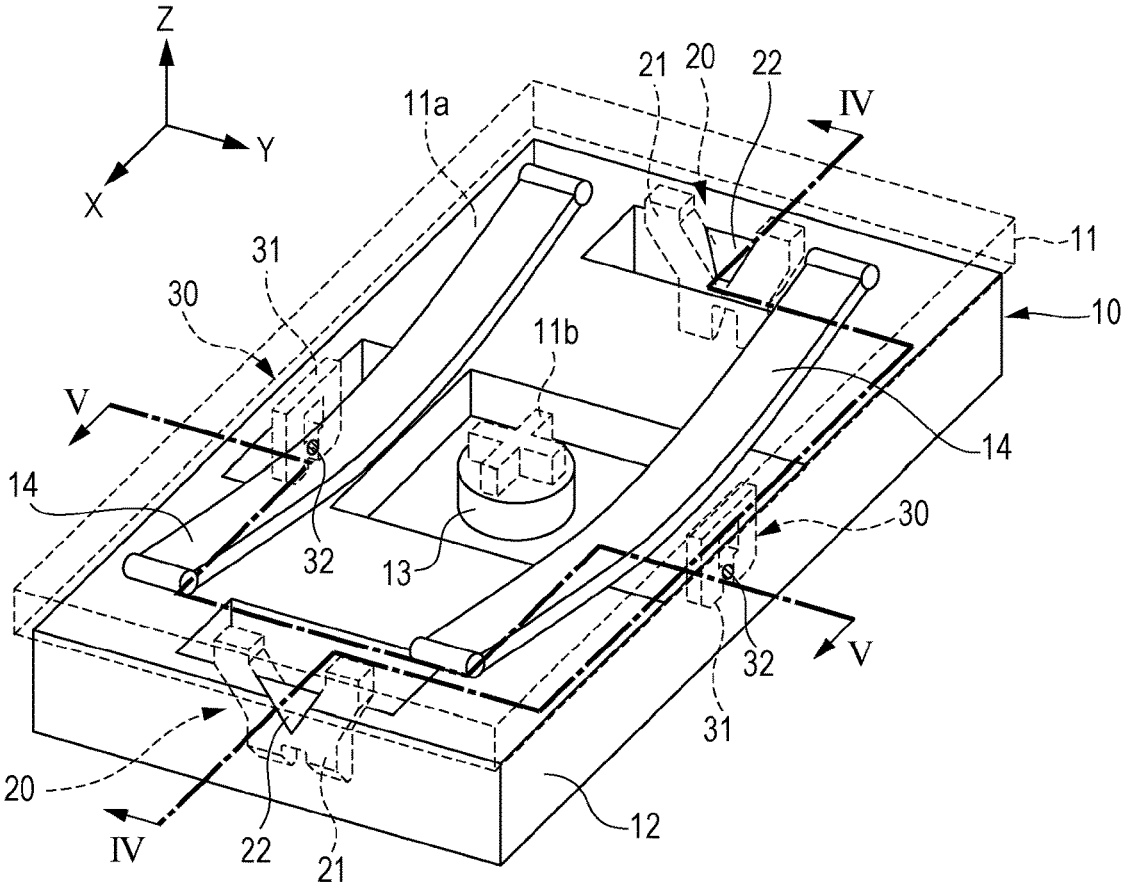
FIG. 2 is a perspective view of one of the press operation apparatuses shown in FIG. 1.
Figure 3:
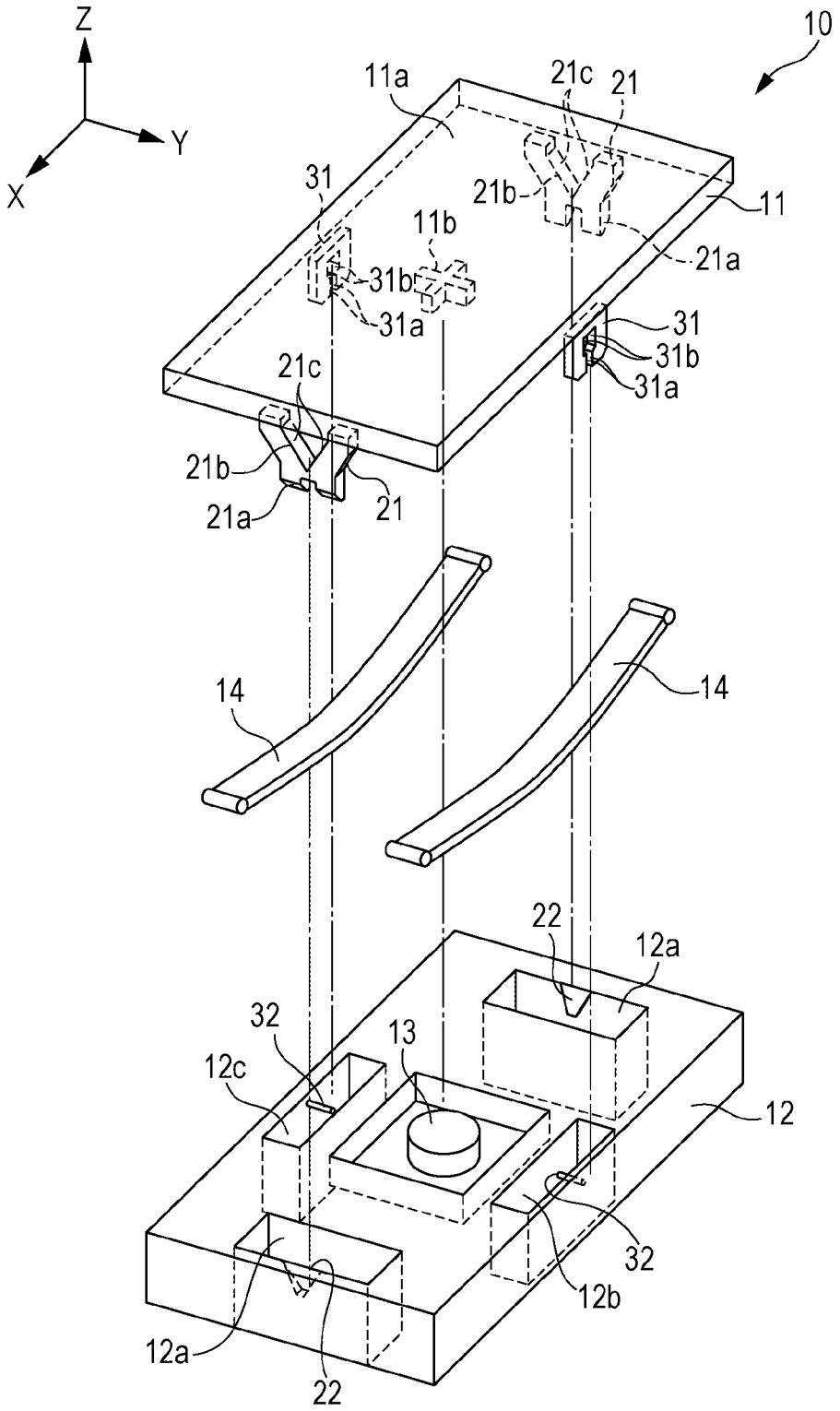
FIG. 3 is an exploded perspective view of the press operation apparatus shown in FIG. 2.

As shown in FIG. 2 and FIG. 3, each press operation apparatus 10 includes a case 12 that is quadrilateral and has openings in the upper surface. Four cases 12 that are made of synthetic resin are provided and secured to the back side of the operation panel 1. The cases 12, however, are not necessarily independent of one another and may be formed integrally such that the four cases are joined together on the back side of the operation panel 1.

Synthetic resin operation bodies 11 that are rectangular press buttons are disposed above the cases 12. As shown in FIG. 1, the operation bodies 11 are aligned within the opening 3 of the operation panel 1. The adjacent operation bodies 11 are arranged with a clearance δs interposed therebetween in the Y-direction within the opening 3. A clearance δx is created between each operation body 11 and the inner edge portions of the opening 3 that face in the X-direction. A clearance δy is created between the operation bodies 11 located at both ends of the operation panel 1 in the Y-direction and the inner edge portions of the opening 3 that face in the Y-direction.

In the press operation apparatuses 10, when the operation bodies 11 are in the return position in which the operation bodies 11 are not pressed, the positions of the operation bodies 11 are set so that the clearance δs can be made uniform at several places, the clearance δx can be made uniform for all of the operation bodies 11, and the clearance δy can be made uniform at both sides in the Y-direction.

In the embodiment, all of the operation bodies 11 have the same dimensions and the same shape. However, the operation bodies 11, for example, having different Y-directional widths may be disposed in combination.

FIG. 2 is an overall perspective view of one of the press operation apparatuses 10. FIG. 3 is an exploded perspective view of the press operation apparatus 10. In FIG. 2, the operation body 11 is shown by a dotted line to clarify the internal structure of the case 12 when the operation body 11 is attached.

As shown in FIG. 2 and FIG. 3, the press operation apparatus 10 is provided with a circuit substrate (not shown) on the lower side of the case 12 shown in the figures. A switch 13 is installed on the circuit substrate. The lower surface of the switch 13 installed on the circuit substrate faces the central inner portion of the case 12 on the lower side shown in the figures. The switch 13 includes a dome-like elastic insulating body and a contact mechanism that conducts electricity when the elastic insulating body is pressed by a pressing projection 11*b*. The pressing projection 11*b* for pressing and actuating the switch 13 is formed integrally at a central portion of the lower surface of the operation body 11.

Two flat springs 14, serving as urging members, that extend in the X-direction are interposed between the operation body 11 and the case 12. The flat springs 14 are made of a synthetic resin material or a metallic flat-spring material. The central portions of the flat springs 14 are secured to the case 12. The operation body 11 is urged by both ends of the flat springs 14 in the direction in which the operation body 11 moves away from the case 12, that is, in the direction in which the operation body 11 moves away from the switch 13 toward the return position in which the operation body 11 does not activate the switch 13.

As shown in FIG. 2 and FIG. 3, the press operation apparatus 10 is provided with two retaining structures 20 that are spaced apart from each other in the first direction (X-direction).

The retaining structures 20 are formed by combining retaining projections 21 and retaining catches 22. The retaining projections 21 are formed integrally with the operation body 11 so as to extend downward in the Z-direction from the lower surface of the operation body 11. The retaining catches 22 are formed within insertion spaces 12*a* formed in the case 12.

Figure 4:
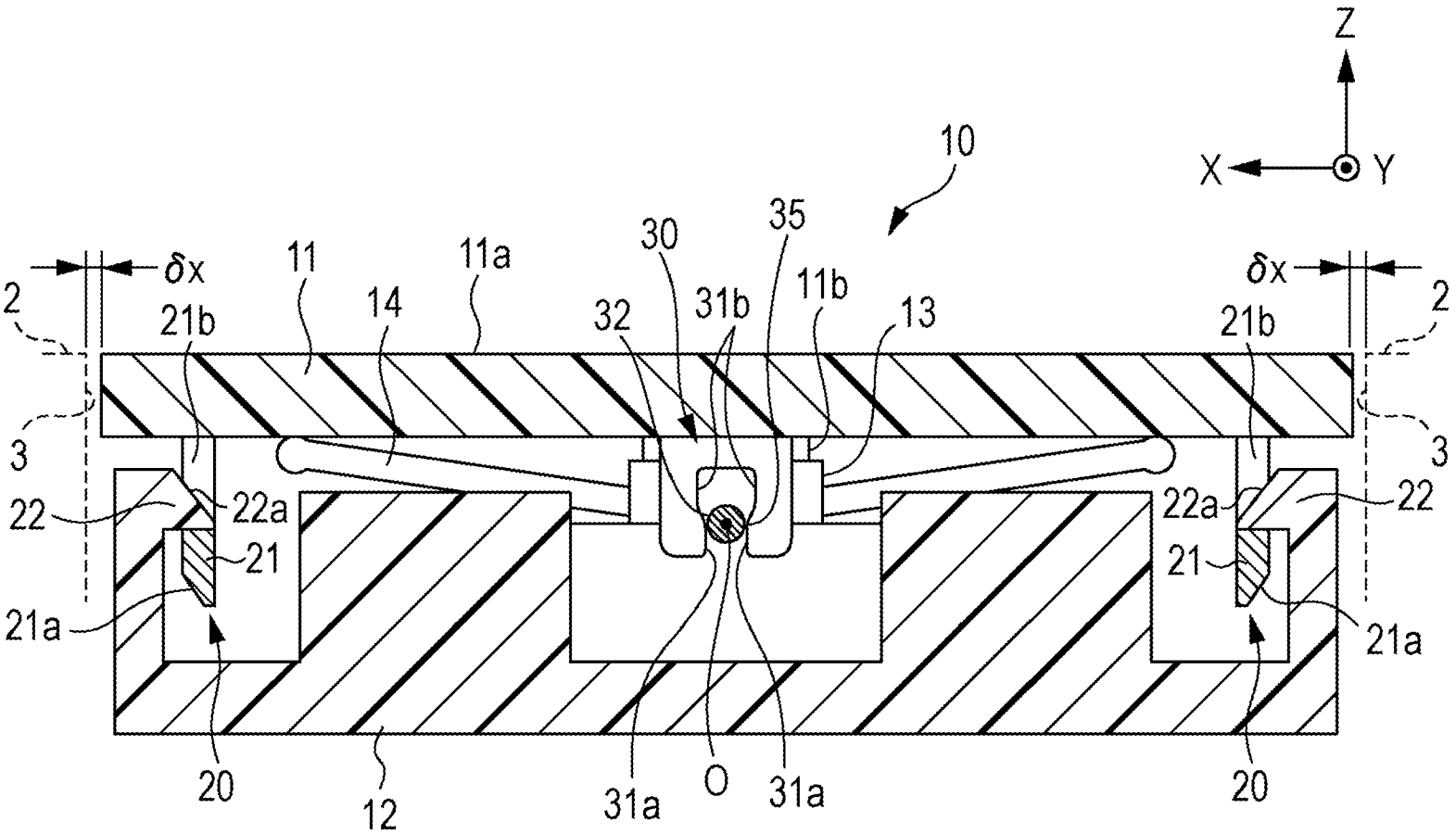
FIG. 4 is a sectional view along line IV-IV shown in FIG. 2 and shows a state where an operation body is in the return position.

As shown in FIG. 3 and FIG. 4, retaining openings 21*b* are formed through the retaining projections 21 in the X-direction. Slanted attachment surfaces 21*a* are formed at the lower ends of the retaining projections 21. Slanted catch surfaces 22*a* are formed on the retaining catches 22 on the sides facing in the X-direction. The slant directions of the slanted attachment surfaces 21*a* and the slanted catch surfaces 22*a* are identical.

When the operation body 11 is attached to the case 12 downward from above, the retaining projections 21 are inserted into the insertion spaces 12*a*, and the slanted attachment surfaces 21*a* come into contact with the slanted catch surfaces 22*a*. When the operation body 11 is depressed, the retaining projections 21 are elastically deformed, and, as shown in FIG. 4, the retaining projections 21 engage with the retaining catches 22 within the retaining openings 21*b*. In this way, the operation body 11 is attached to the case 12 so as not to be detached from the case 12. The operation body 11 is attached to the case 12 merely by depressing the operation body 11 from above toward the case 12. The operation body 11 is thus easy to attach.

Figure 7:
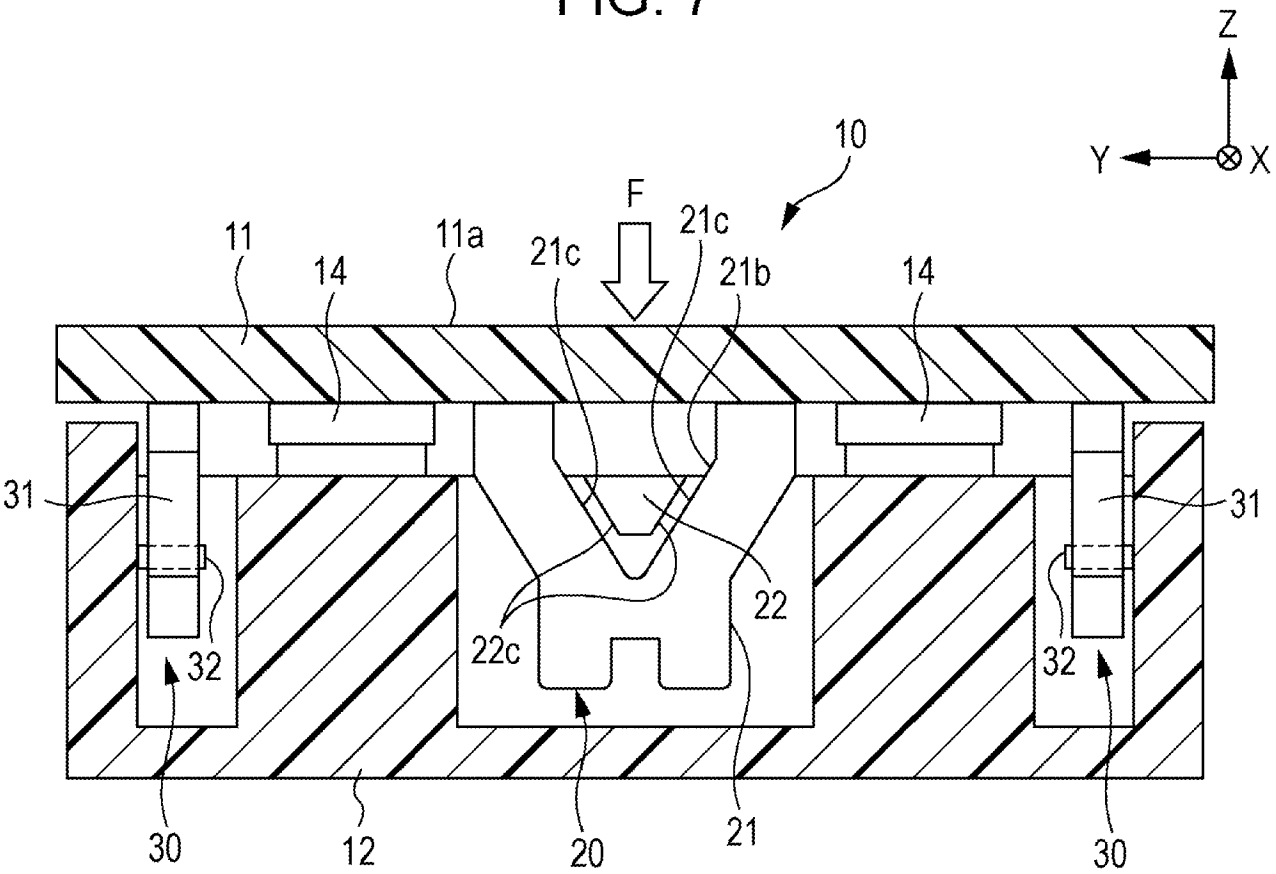
FIG. 7 is an explanatory view of the action of the press operation apparatus and a sectional view along line V-V that shows a state where the operation body is pressed.

As shown in FIG. 7, around the retaining opening 21*b* formed through the retaining projection 21, a pair of slanted retaining portions 21*c* are formed such that the distance between the slanted retaining portions 21*c* in the Y-direction gradually decreases downward. On both sides of the retaining catch 22, a pair of slanted retaining portions 22*c* are formed such that the distance between the slanted retaining portions 22*c* in the Y-direction gradually decreases downward.

Figure 5:
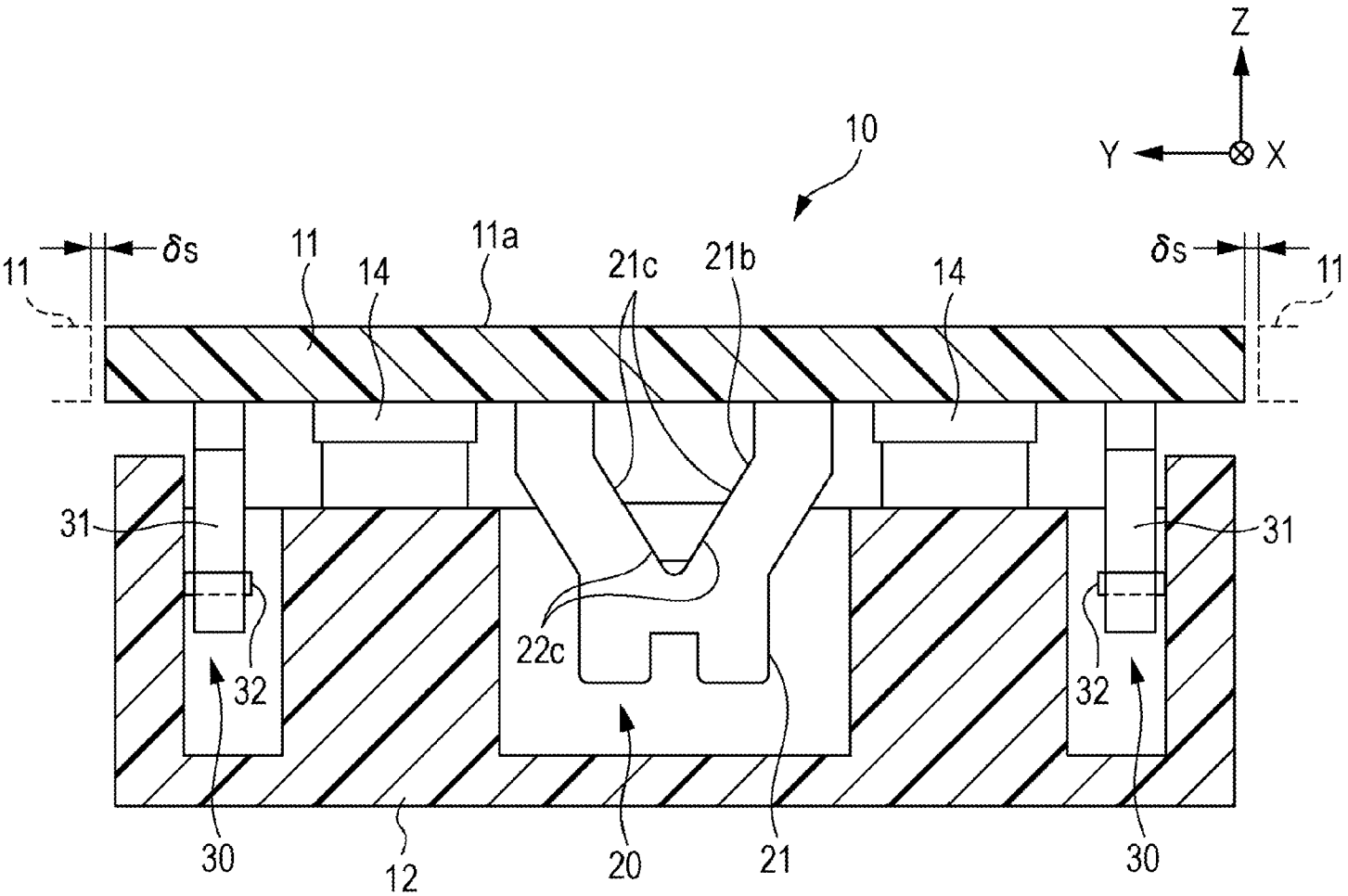
FIG. 5 is a sectional view along line V-V shown in FIG. 2 and shows a state where the operation body is in the return position.

As shown in FIG. 5, while the operation body 11 is not pressed, the operation body 11 is urged by the flat springs 14 in the upward direction shown in the figure and the slanted retaining portions 21*c* of the retaining projection 21 are in contact with the slanted retaining portions 22*c* of the retaining catch 22. In this way, the position of the operation body 11 in the Y-direction, which is the second direction, is set. In addition, the distance between the case 12 and the operation body 11 is set, and the height of an operation surface 11*a* of the operation body 11 is set. Setting the positions of the operation bodies 11 enables the clearance δy and the clearance δs shown in FIG. 1 to be made uniform at several places and also enables the operation surfaces 11*a* of the operation bodies 11, as shown in FIG. 1, to be flush with one another.

In each retaining structure 20, the slanted retaining portions 21*c* may be formed only in the retaining projection 21 and two contact portions that come into contact with the respective slanted retaining portions 21*c* may be formed in the retaining catch 22, or alternatively the slanted retaining portions 22*c* may be formed only in the retaining catch 22 and two contact portions that come into contact with the respective slanted retaining portions 22*c* may be formed in the retaining projection 21. In this way, the positions of the operation bodies 11 in the Y-direction and the Z-direction can be set when the operation bodies 11 are in the return position.

The retaining projections 21 may be formed integrally with each case 12 so as to protrude upward and the retaining catches 22 may be formed integrally with each operation body 11. In this case, the slanting directions of the slanted retaining portions 21*c* and the slanted retaining portions 22*c* are upside down compared with the configuration shown in FIG. 5 and FIG. 7.

As shown in FIG. 2, two positioning structures 30 are arranged midway between the two retaining structures 20 that are arranged so as to be spaced apart from each other in the X-direction (first direction), and the positioning structures 30 are spaced apart from each other in the V-direction (second direction). Although the positioning structures 30 are preferably located at the midway points between the retaining structures 20, the positioning structures 30 may be located at positions away from the midway points toward one of the retaining structures 20.

Figure 6:
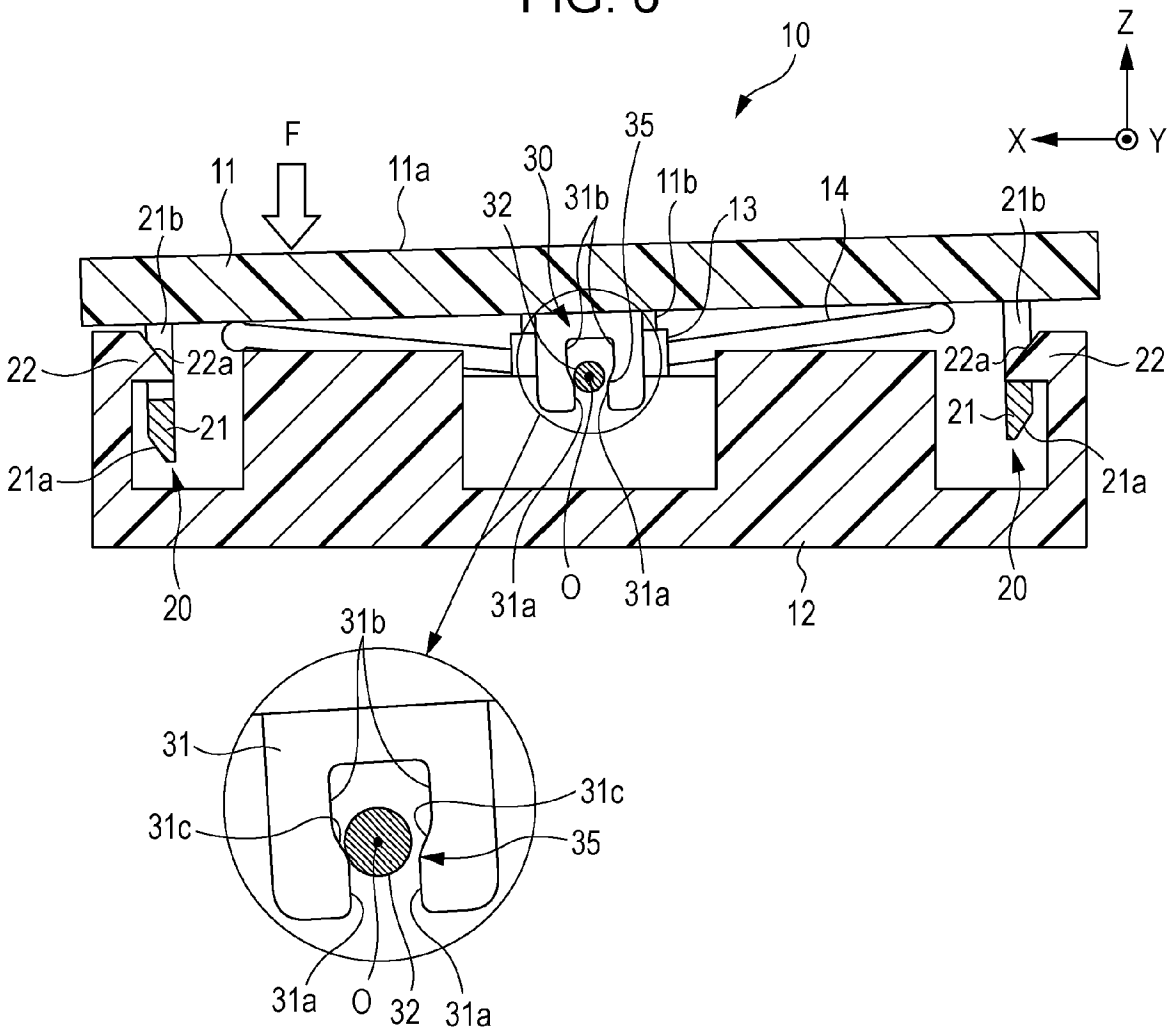
FIG. 6 is an explanatory view of the action of the press operation apparatus and a sectional view along line IV-IV that shows a state where the operation body is pressed.

As shown in FIG. 2, FIG. 4, and FIG. 6, in each positioning structure 30, a support 31 is formed integrally with the operation body 11 downward from the lower surface of the operation body 11. In the case 12, insertion spaces 12*b* are formed and projections 32 are integrally formed inside the insertion spaces 12*b*.

A pair of opposing positioning portions 31*a* are formed so as to oppose each other in the X-direction at the lower end of each support 31. Opposing releasing portions 31*b* are formed so as to oppose each other in the X-direction at positions above the respective opposing positioning portions 31*a* with respect to the Z-direction (third direction). The distance between the opposing releasing portions 31*b* in the X-direction is longer than the distance between the opposing positioning portions 31*a* in the X-direction. Slanted boundary portions 31*c* are formed at the boundary between the opposing positioning portions 31*a* and the opposing releasing portions 31*b*.

The projections 32 protrude in the Y-direction from the case 12. Each projection 32 is cylindrical and has a diameter slightly smaller than or equal to the distance between the opposing positioning portions 31*a* in the X-direction.

While the operation body 11 is in the return position in which the operation body 11 is not pressed, the operation body 11 is urged by the flat springs 14 in the upward direction shown in the figures, and the positions of the operation body 11 in the Y-direction and the Z-direction are set by the retaining structures 20, as described above. At this time, as shown in FIG. 4, the projection 32 is held between the opposing positioning portions 31*a* from both sides in the X-direction. The position of the operation body 11 in the X-direction, which is the first direction, is thereby set by the two positioning structures 30 that are spaced apart from each other in the Y-direction.

As shown in FIG. 1, this function of setting the position achieves uniform clearance δx between each operation body 11 and the inner edge portions of the opening 3 of the panel surface 2 that face in the X-direction.

The positions of the operation body 11 in the X-direction and the Y-direction can be set by the two retaining structures 20 and the two positioning structures 30 when the operation body 11 is in the return position in which the operation body 11 is not pressed, and the clearances δy, δx, and δs shown in FIG. 1 can thereby be made uniform. The position of the operation body 11 in the Z-direction can be set by bringing the slanted retaining portions 21*c* and the slanted retaining portions 22*c* of the retaining structures 20 into contact with each other, and a distinct step can be prevented from being formed between the adjacent operation surfaces 11*a* of the operation bodies 11 aligned within the opening 3.

The action of each press operation apparatus 10 is described below.

FIG. 6 and FIG. 7 are explanatory views of the action of the press operation apparatus when the operation body 11 is pressed. FIG. 6 is a sectional view along line IV-IV shown in FIG. 2. FIG. 7 is a sectional view along line V-V shown in FIG. 2.

In the case where the operation body 11 in the return position is depressed against the urging force of the flat springs 14, the operation body 11 tends to be pressed at a position away from the central portion of the operation body 11 in the X-direction (first direction).

In FIG. 6, a pressing force F is applied to the operation body 11 at a position away from the central portion to the left hand side. At this time, the operation body 11 moves so as to pivot in the counterclockwise direction shown in the figure on the retaining portions of the retaining structure 20 on the right hand side shown in the figure, and the switch 13 is pressed by the pressing projection 11*b* and activated.

As shown in FIG. 6, when the operation body 11 pivots counterclockwise on the retaining structure 20 on the right hand side, the opposing positioning portions 31*a* disposed on the operation body 11 attempt to pivot such that the midway point between the opposing positioning portions 31*a* is along an arc trajectory Φ centered on the pivot. The pairs of opposing positioning portions 31*a*, on the other hand, are linearly formed in a direction perpendicular to the lower surface of the operation body 11. In other words, the opposing positioning portions 31*a* are not formed along the arc trajectory Φ. Accordingly, supposing the projections 32 do not move away from the opposing positioning portions 31*a* during the pivot movement, the opposing positioning portions 31*a* that attempt to pivot continue to be restricted by the projections 32. While the operation body 11 pivots and the opposing positioning portions 31*a* continue to be restricted by the projections 32, the resistance produced when the operation body 11 is pressed is extremely large.

In the press operation apparatus 10, right after the operation body 11 begins pivoting from the return position shown in FIG. 4 and FIG. 5, the projections 32 can move away from the pairs of opposing positioning portions 31*a* to positions between the opposing releasing portions 31*b*. Accordingly, the resistance produced when the operation body 11 is pressed can be reduced, and operability can be improved.

The resistance can be reduced by moving the projections 32 away from the pairs of opposing positioning portions 31*a* also when a pressing force F is applied to the operation body 11 at a position away from the center to the right hand side in contrast to FIG. 6, and the operation body 11 pivots in the clockwise direction shown in the figure on the retaining structure 20 on the left hand side.

Thus, when the operation body 11 is pressed, the operation body 11 pivots on the retaining structure 20 disposed at one of the ends of the press operation apparatus in the X-direction. The operation body 11 can accordingly be pressed stably and good operability can be achieved.

When the operation body 11 is pressed at the central portion of the operation body 11 in the X-direction, the operation body 11 is depressed in a horizontal position and the resistance does not become large.

When the operation body 11 is in the return position as shown in FIG. 4, the center O of the projections 32 and the upper end 35 of the opposing positioning portions 31*a* in the Z-direction preferably have the same height in the Z-direction, so that the projections 32 can rapidly move away from the pairs of opposing positioning portions 31*a* when the operation body 11 pivots on one of the retaining structures 20. A pivot angle from when the operation body 11 begins pivoting on one of the retaining structures 20 until the switch 13 is activated is referred to as a maximum movement angle. In this case, the projections 32 preferably move away from the opposing positioning portions 31*a* until the operation body 11 in a hooked position pivots by half of the maximum movement angle. Moreover, the projections 32 preferably move away from the opposing positioning portions 31*a* until the operation body 11 pivots by one third of the maximum movement angle from the beginning of pivoting.

What is claimed is:

1. A press operation apparatus comprising:

a case;

an operation body disposed on the case;

a switch disposed in the case and configured to be activated by pressing the operation body;

an urging member disposed on the case and urging the operation body in a direction opposite to a direction in which the operation body is pressed;

retaining structures arranged so as to be spaced apart from each other in a first direction; and positioning structures arranged between the retaining structures so as to be spaced apart from each other in a second direction perpendicular to the first direction, wherein each of the positioning structures includes a projection and opposing positioning portions, the projection is disposed on one of the operation body and the case, the opposing positioning portions oppose each other in the first direction and are disposed on the other of the operation body and the case, the projection is interposed between the opposing positioning portions when the operation body is moving in the direction opposite to the direction in which the operation body is pressed, and a position of the operation body in the first direction is set, and wherein the projection moves away from the opposing positioning portions when the operation body is pressed and pivots on one of the retaining structures.

2. The press operation apparatus according to claim 1, wherein each of the positioning structures includes a support, and wherein the opposing positioning portions and opposing releasing portions that oppose each other at a distance longer than a distance between the opposing positioning portions are disposed on the support such that each of the opposing positioning portions and a corresponding one of the opposing releasing portions are aligned in the direction in which the operation body is pressed.

3. The press operation apparatus according to claim 1, wherein one of the operation body and the case includes a retaining projection extending in a third direction perpendicular to the first direction and the second direction, the other of the operation body and the case includes a retaining catch, and the retaining projection is elastically deformed and engages with the retaining catch when the operation body is attached to the case.

4. The press operation apparatus according to claim 3, wherein at least one of the retaining projection and the retaining catch includes a pair of slanted retaining portions that are slanted with respect to the third direction, and the position of the operation body in the second direction is set by the slanted retaining portions when the operation body is moving in the direction opposite to the direction in which the operation body is pressed.

* * * * *